United States Patent [19]

Mennel

[11] 4,408,475

[45] Oct. 11, 1983

[54] ROLLING MILL ROLLS

[75] Inventor: Gabriel B. Mennel, Nilvange, France

[73] Assignee: Sacilor Acieries et Laminoirs de Lorraine, Hayange, France

[21] Appl. No.: 230,335

[22] Filed: Feb. 2, 1981

[30] Foreign Application Priority Data

Feb. 4, 1980 [FR] France ..... 80 02383

[51] Int. Cl.[3] ..... B21B 1/08

[52] U.S. Cl. ..... 72/221; 72/226

[58] Field of Search ..... 72/221, 226, 228, 229, 72/234, 250, 366, 365

[56] References Cited

U.S. PATENT DOCUMENTS 341,570 5/1886 Graham ..... 72/221

4,370,877 2/1983 Michaux ..... 72/222

FOREIGN PATENT DOCUMENTS 567047 11/1954 Fed. Rep. of Germany .

1012887 2/1924 France .

*Primary Examiner*—Francis S. Husar

*Assistant Examiner*—Jonathan L. Scherer

*Attorney, Agent, or Firm*—Schroeder, Siegfried, Vidas & Arrett

[57] ABSTRACT

The present invention discloses an arrangement of grooves on the rolls of a rolling mill stand intended particularly for the rolling of beams, rails, channels, squares, diamonds, rounds, tie plates, joint bars and similar shapes wherein a plurality of grooves for shapes with different web heights are nested on the same set of rolls in such a way that the whole of the part of a groove serving as a surround to the shortest web is common to all the nested grooves.

3 Claims, 7 Drawing Figures

ROLLING MILL ROLLS

The present invention is concerned with the rolls of stands particularly edgers of a universal rolling mill for beams, rails or other similar shapes wherein a plurality of different grooves are arranged on a single set of rolls.

The invention also concerns rolling mills and mill stands utilising such rolls.

In the known universal rolling mills for implementing the known process of universal rolling of beams, such as revealed among others by American Patent No. 1,812,246, rolling mills which may include several universal stands as well as a number of edger stands, the edger stand rolls comprise only one groove for a single profile. When the edger stands are reversible, the gap between rolls may be set according to the required height of flange, which makes it possible to provide for a certain number of edging passes, but solely for a single shape. On a non-reversing edger stand, the spacing of the rolls remains fixed and the single groove enables only one pass, always for a single shape only. This state of the art, whenever the rolled shape is changed, makes it necessary to replace the edger rolls of the rolled shape beforehand by specific edger rolls for the shape which will then be rolled. Moreover, as a set of edger rolls, at a given moment, can only serve to roll a single shape, it is nevertheless indispensable to have available a large stock of sets of edger rolls so as to be able to roll the whole range of the shapes of a rolling mill, even if certain well-known methods of re-using rolls for close shapes make it possible to reduce the number of rolls to some extent. Although the only essential function of the edger rolls is to edge very limited parts of a shape (ends of beam flanges for example) and that consequently only a very limited part of the rolls is active, it is indispensable to purchase at the full price and then to able to resell only at scrap value a large amount of metal which does not actually participate in the edging action on the shape. This inactive amount of metal is constituted essentially by what is called the arbor or mandrel of the rolls. Although the technique of sleeving makes it possible to reduce the scrapping of the roll arbors by several consecutive re-uses of the latter, nevertheless even a sleeved roll remains specific to a shape at a given moment.

The purpose of the invention is to remove these disadvantages by optimising the use of the maximum possible barrel length for the edger rolls of an existing edger stand (or one specially designed or converted for this purpose), thus improving the profitability of a universal shape rolling mill essentially by enabling:

a reduction of the tonnage of edger rolls purchased and scrapped, a reduction of the number of sets of edger rolls necessary to carry out the manufacturing programme of the rolling mill, a reduction of the frequency of replacement operations of the edger rolls when changing the rolled shapes, this reduction of course leading to savings in labour, fitting and handling and, in certain cases, an increase in the production capacity of a rolling mill due to the reduction of its downtime, a reduction of the costs of handling the edger rolls between the storage yards, the rolling mill and the roll shop, likewise the areas required for storage and a reduction of the costs involved by the fitting and taking down of rolls on the lathes at the roll shop.

These advantages are obtained without additional investment and without changing the method of operation of the stands particularly edgers and rolling mills, unless the latter are specially designed or adapted to draw maximum advantage from the invention. In the latter case, the additional investment may moreover be only minor.

According to the present invention there is provided a set of rolls for a rolling mill stand having grooves, particularly edging grooves for shapes with different heights such as beams, rails, channels, diamonds, rounds, tie plates, joint bars or other similar shapes, characterised in that they comprise a plurality of grooves for shapes with different web heights, nested in such a way that the whole of the part of a groove serving as a surround to the shortest web is common to all the nested grooves.

The nesting of the grooves may be carried out in such a way that the vertical planes of symmetry of the grooves are all merged in a common plane, which is advantageously the transversal median plane of the rolls, or moreover in such a way that at least one of the vertical planes of symmetry of the grooves is merged with the transversal median plane of the rolls.

It is possible to arrange on the same set of rolls various groups of nested grooves, these groups being themselves completely separate, or nested, or even overlapped, and each one capable of comprising at least one similar edging groove.

The invention also includes a stand particularly an edger stand comprising rolls with nested grooves as aforesaid, such stand being with lifting and screw-down, reversing or non-reversing.

The invention further includes a rolling mill comprising at least one edger stand comprising rolls with nested grooves as aforesaid, said rolling mill being conventional or universal.

The present invention will be better understood with the aid of the following description, on the one hand of the state of the art, and on the other hand of a number of embodiments according to the invention, the whole being illustrated by the appended drawings in which.

Figure 1:
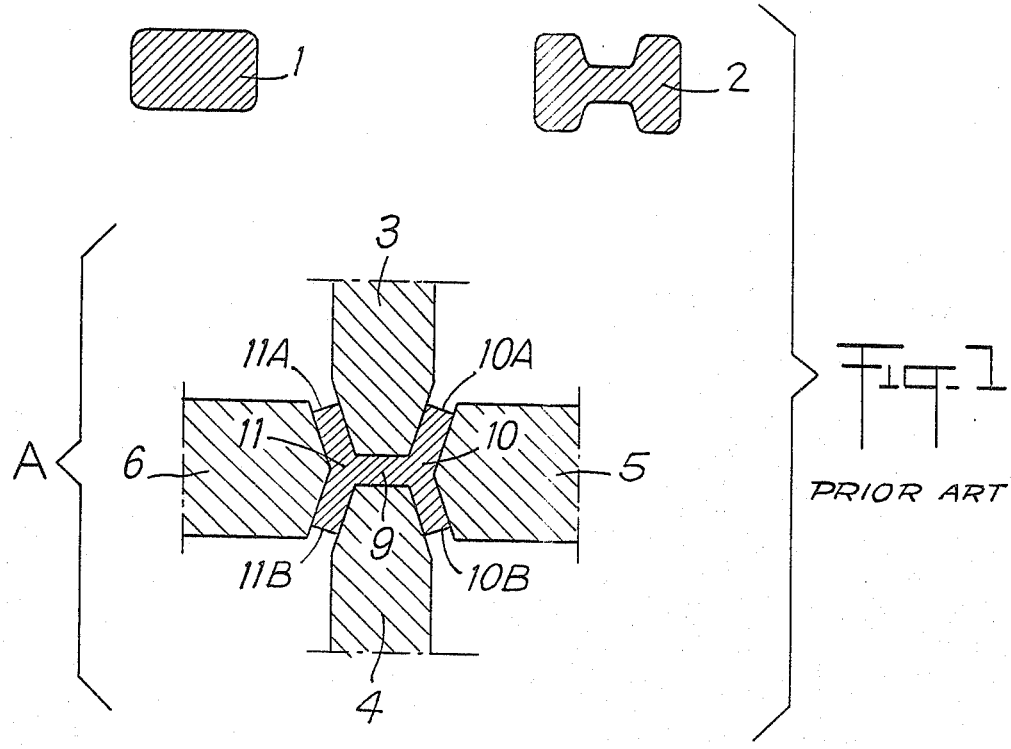
FIG. 1 PRIOR ART
FIGS. 1 and 2 represent diagrammatically the various phases of the previous art of univeral beam rolling.

In the previous state of the art of univeral beam rolling as represented in FIG. 1, a bloom 1 is converted (by a rolling mill not shown) into a blank 2. The blank 2 is then rolled by successive passes in one or more univeral stands (first phase A) including two horizontal rolls 3 and 4 and two vertical rollers 5 and 6, and in one or more edger stands (second phase B) including two horizontal rolls 7 and 8, to terminate in a universal finishing stand (not shown).

During the passes of phase A, the horizontal rolls 3 and 4 exert a direct pressure on the web 9 and the inside faces of the flanges 10 and 11, whilst the vertical rollers 5 and 6 exert direct pressures on the outside faces of flanges 10 and 11.

During the passes of the second phase B, called edging, the horizontal rolls 7 and 8 exert no direct pressure on the inside and outside faces of the flanges 10 and 11, nor on the web 9 of the profile, but on the contrary, respectively on the ends 10A, 10B and 11A, 11B of flanges 10 and 11.

On a reversing rolling mill, with each pass of the profile in the edger stand, the spacing of the rolls is set between each pass. On a continuous rolling mill, the spacing of the rolls is set at the assembly and remains fixed.

The main role of the edger stand is to fix (control) the flange height, then to edge correctly the ends 10A, 10B and 11A, 11B of flanges 10 and 11, by edging, to obtain equal half flanges symmetrical in relation to the web 9 of the beam. The rolls do not touch the inside part of the beams nor the outside faces of the flanges, only the ends of the flanges.

The invention consists in rendering common, for a plurality of grooves particularly different edging, the parts of rolls surrounding the webs 9 of the profiles by nesting a plurality of grooves, the nesting being done preferably in such a way that the median planes of longitudinal symmetry of the webs of all the different nested grooves are merged.

Figure 2:
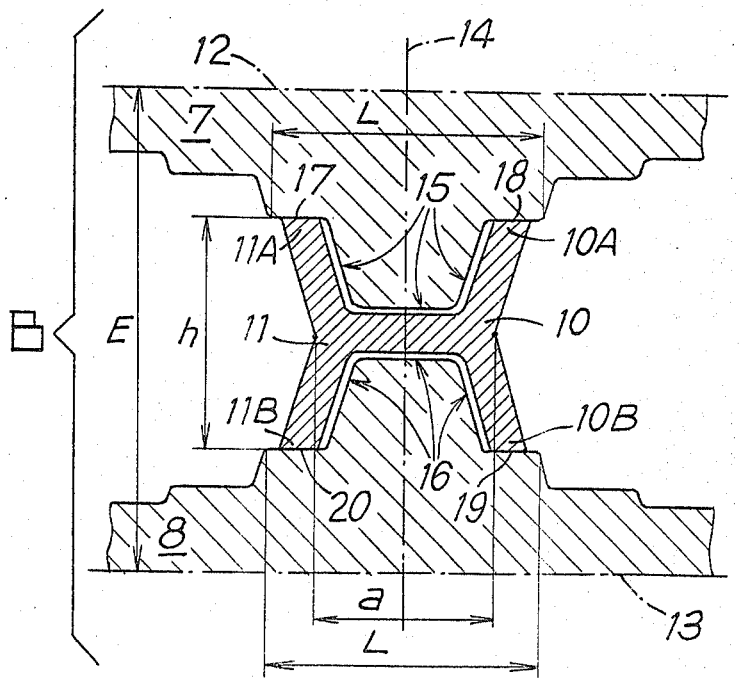
FIG. 2 PRIOR ART

FIG. 2 is a partial section in a radial plane passing via the axes of the rolls, of two edger rolls of the state of the art. The two rolls 7 and 8 turn around their respective horizontal axes 12 and 13. The gap E between these two rolls is adjustable. These rolls are mounted on a stand (not shown). The reference L indicates here as on the other figures of the barrel length used of the edger rolls. On the same FIG. 2 a shape (profile) is represented which here is a beam of web height a at the time of the pass considered and of flange height h, also at the time of the pass considered. In all of the following, whenever the terms web height and flange height are used, it will always be for heights at the time of the pass considered, these heights being able to be varied between the passes in a same groove. The vertical plane of longitudinal symmetry of the beam and the vertical plane of symmetry of the groove are merged and shown by their trace 14.

The parts 15 and 16 of the grooves which are respectively on rolls 7 and 8 have only a guiding role. The groove parts 17, 18, 19 and 20 are the only ones to exert a rolling action respectively on the ends 11A, 10A, 10B, 11B of flanges 10 and 11.

Figure 3:
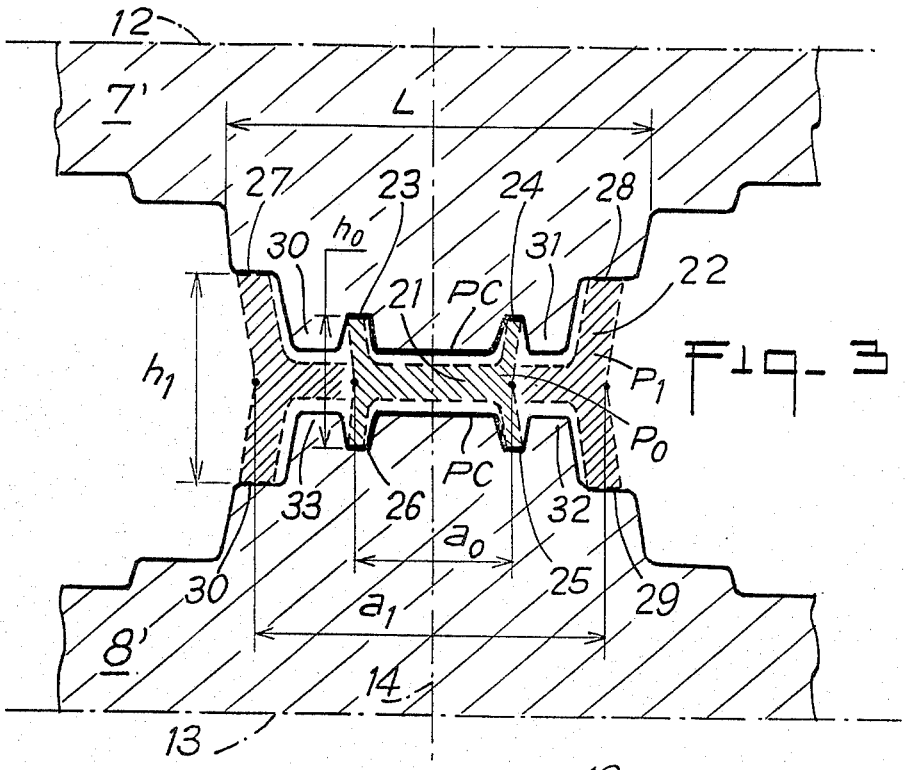
FIG. 3 represents in section the nested edging grooves according to the invention for two different profiles having the same configuration (shape)

FIG. 3 represents a first arrangement according to the invention of a plurality of different edging grooves on the rolls of a two-high edger stand. It goes without saying that the invention is not limited to two-high stands only. It can also be applied on a three-high stand or any other stand.

For greater clarity, the grooves have only been shown for two beams 21 and 22 of very different web heights $a_o$ and $a_1$, and flange heights $h_o$ and $h_1$ which may be different (as on FIG. 3) or equal. The vertical planes of symmetry of the two grooves are merged and indicated by their trace 14.

On the rolls 7' and 8' the bottoms 23, 24, 25 and 26 of one of the grooves, intended to edge the ends of the flanges of beam $P_o$ are separated by collars 30, 31, 32 and 33 from the bottoms 27, 28, 29 and 30 of the other groove, the latter bottoms being intended for edging the ends of the flanges of beam $P_1$. According to the rules of the art, these collars must be of adequate thickness so that they do not break, although they do not exert any pressure and serve at most for guiding the shapes. It is clear that the edging grooves of more than two different shapes can be arranged on the same set of rolls, on the condition that the shapes are judiciously selected and that said rolls are given only the maximum barrel length possible with the edger stand.

The parts of grooves which surround the webs of beams $P_o$ and $P_1$ do not exert any rolling action. According to an essential characteristic of the invention, it is the parts of grooves which surround the shape with the shortest web height which are common to all the nested grooves. These common parts of grooves are indicated by PC and marked in thicker lines only on FIGS. 3 and 4 so as not to complicate the understanding of the other figures.

Figure 4:
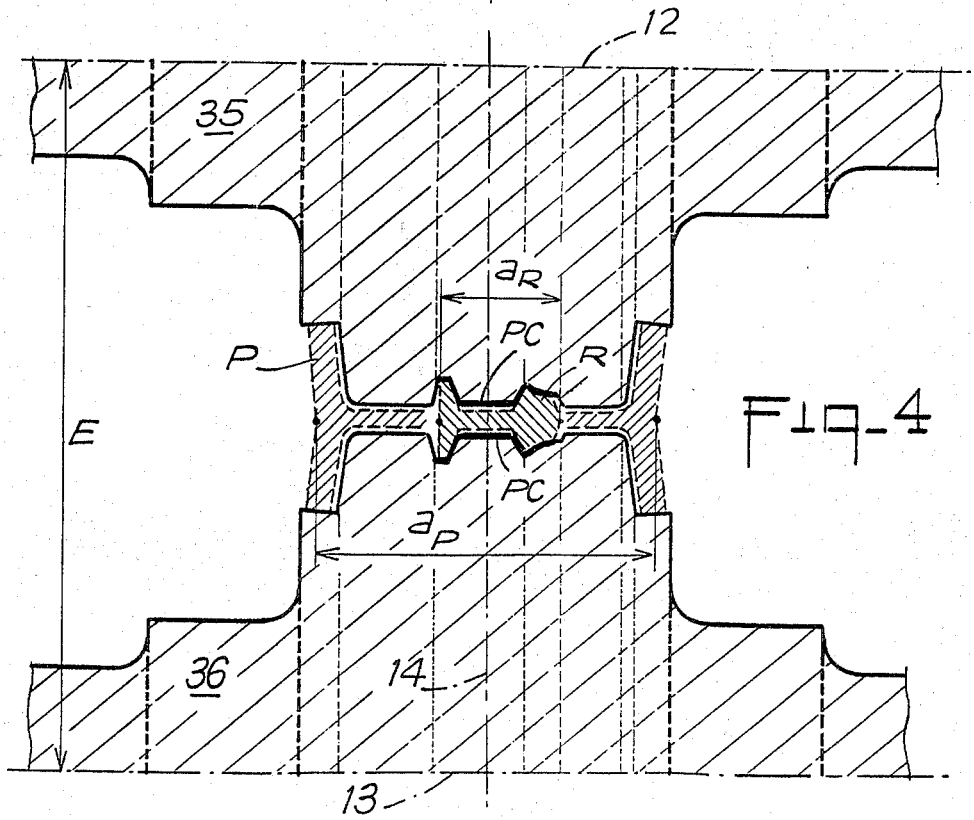
FIG. 4 represents in section the nested edging grooves according to the invention for two profiles of different configuration.

The profiles (shapes) may be of the same configuration but of different size, as on FIG. 3, or of different configuration as on FIG. 4 which shows rolls 35 and 36 on which are arranged a groove of beam P of web height $a_p$ and a different groove of a rail R with web height $a_R$ according to the definition already given. The vertical planes of symmetry of the two different grooves are in this case also merged and shown by their trace 14, although it can be easily understood that they may not be merged.

Figure 5:
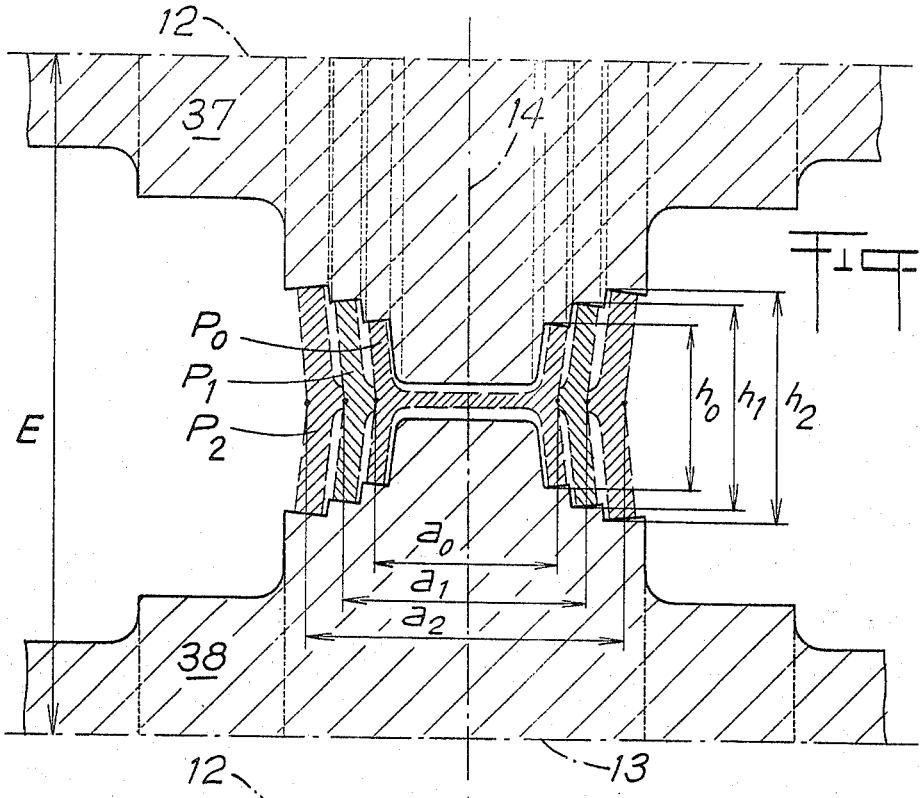
FIG. 5 represents in section the nested edging grooves according to the invention for several profiles of the same configuration, in this case the nesting being stepped.

When the web heights of several different shapes are such that the arrangement of their grooves on a same set of rolls does not make it possible to provide for adequate collar thicknesses it is possible, according to one variant of the invention, to remove one or more of these collars and obtain a stepped arrangement of the groove bottoms, that is to say another form of nesting the grooves according to the invention, as shown in FIG. 5. It represents the nested grooves of three beams $P_o$, $P_1$, $P_2$ respectively with web heights $a_o$, $a_1$, $a_2$ and different flange heights $h_o$, $h_1$, $h_2$. The vertical planes of symmetry of the nested edging grooves are in this case merged for preference. The arrangement represented by FIG. 5 is characterised by a stepped nesting of the edging grooves of the invention.

Figure 6:
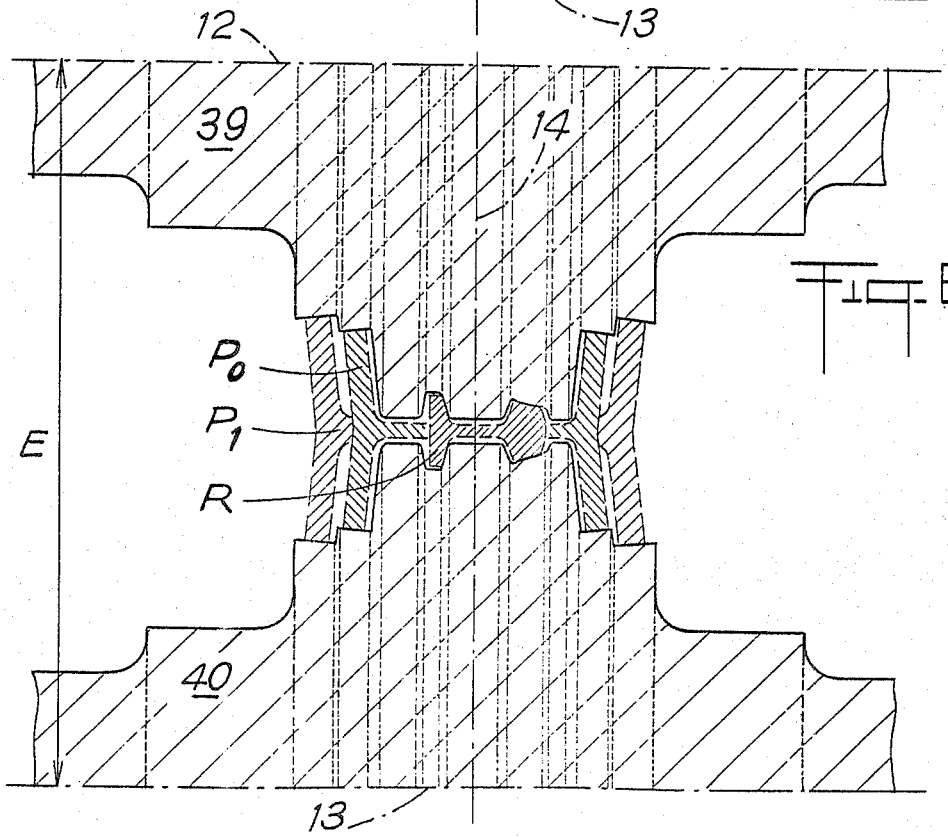
FIG. 6 represents in section the nested edging grooves according to the invention for a plurality of profiles of different configuration, with a combination of two variants of nesting.

Any combination of the above cases can be made within the scope of the invention, as for example the one represented by FIG. 6 in which edger rolls 39 and 40 have a combination of step nested edging grooves of two beams $P_o$ and $P_1$ and a nested edging groove of a rail R.

As one of the purposes of the invention is to enable is to be brought into use without additional investment or substantial modification of the method of operation of the rolling mill on which it is used, the preferred embodiments of the invention are described for cases where the vertical planes of longitudinal symmetry of all the distinct, nested edging grooves are merged. This single longitudinal plane of symmetry of all the nested grooves is merged with the vertical plane of rolling when the stands are one behind each other.

The variant already described, such as illustrated by FIG. 6 is placed within the hypothesis of the arrangement of shapes, in the circumstances of beams $P_o$, $P_1$ and $P_2$ of different web lengths $a_o$, $a_1$, $a_2$ and of different flange heights $h_o$, $h_1$, $h_2$. The very small differences of length which exist in the case envisaged between the webs of two adjacent beams, starting from the shortest web make a stepped nesting of the grooves desirable, as shown by FIG. 5.

Figure 7:
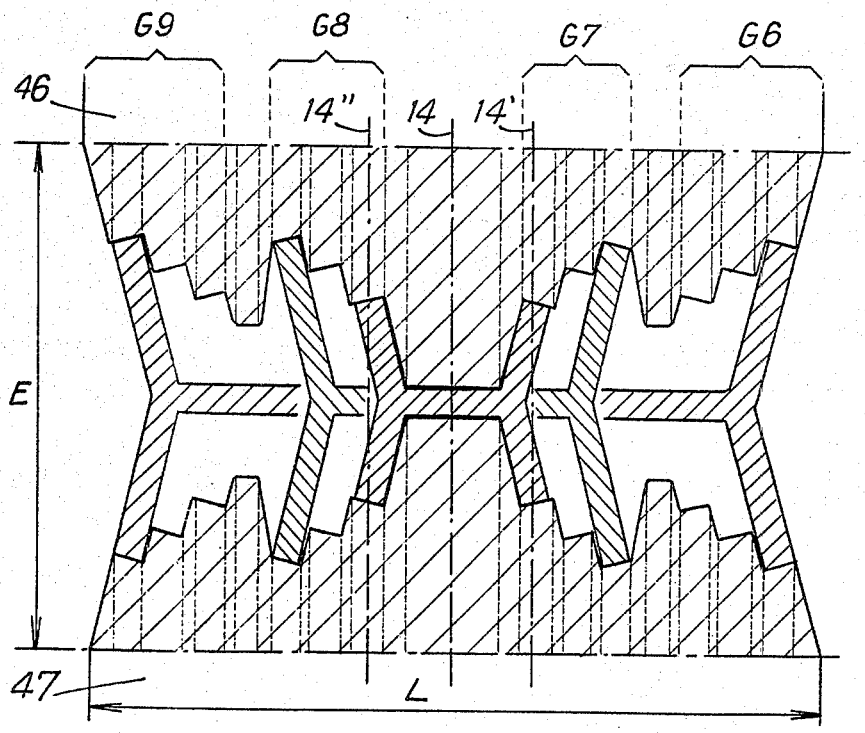
FIG. 7 represents in section nested edging grooves according to the invention for a plurality of different profiles, distributed in two nested groups of nested grooves.

In another variant of the present invention, combined with another invention of the applicant, as shown in FIG. 7, it is possible to have on the barrel length L of rolls 46 and 47 a more varied choice of grooves for beams of different or similar web and flange heights. $G_6$, $G_7$, $G_8$ and $G_9$ indicate groups of steps which may be associated to obtain required web heights, by varying or not varying the inter-axis E of the rolls to obtain the corresponding flange heights. The reference numerals 14, 14' and 14'' designate the traces of the vertical planes of symmetry of the groups of steps represented, namely numeral 14 of the groups of steps $G_6$ and $G_9$, $G_7$ and $G_8$, numeral 14' of the groups of steps $G_6$ and $G_8$, and numeral 14'' of the groups of steps $G_7$ and $G_9$. If, on the one hand, the steps $G_6$ and $G_9$ are combined, and on the other hand steps $G_7$ and $G_8$, two nested groups of nested grooves are obtained. If steps $G_6$ and $G_8$ on the one hand and steps $G_7$ and $G_9$ on the other hand are combined, two overlapping groups of nested grooves are obtained.

As has been said, the invention also concerns a univeral rolling mill of which at least one edger stand is provided with rolls having distinct edging grooves nested according to the invention.

The embodiments already described have been given by way of example for guidance, not in the least limiting and it is possible to devise the arrangements side by side of a plurality of separate groups of nested edging grooves, in cases where the barrel lengths of the edger rolls so permit.

I claim:

1. A rolling mill stand serving particularly for the edging of shapes such as rails, beams, channels, squares, diamonds, rounds, tie plates, joint bars or other similar shapes, characterized in that it comprises a set of rolls having a plurality of grooves for shapes with different web heights, nested in such a way that the whole of the part of a groove serving as a surround to the shortest web is common to all the nested grooves in such a way that the vertical plane of symmetry of at least one nested groove is merged with the transversal median plane of the rolls.

2. A rolling mill for shapes such as rails, beams, channels, squares, diamonds, rounds, tie plates, joint bars or other similar shapes, characterized in that it comprises universal stands, at least one stand having a set of rolls with a plurality of grooves for shapes with different web heights, nested in such a way that the whole of the part of a groove serving as a surround to the shortest web is common to all the nested grooves.

3. A rolling mill for shapes such as rails, beams channels or other shapes comprising:

universal stands, and at least one edger stand having a set of rolls with a plurality of grooves each having a vertical plane of symmetry for shapes with different web heights, said grooves being nested in such a way that the whole of the part of a groove serving as a surround to the shape having the shortest web height is common to all the nested grooves and the vertical planes of symmetry of all grooves are merged in a common vertical plane of symmetry.

* * * * *

UNITED STATES PATENT AND TRADEMARK OFFICE

CERTIFICATE OF CORRECTION

PATENT NO. : 4,408,475

DATED : October 11, 1983

INVENTOR(S) : Gabriel B. Mennel

It is certified that error appears in the above-identified patent and that said Letters Patent is hereby corrected as shown below:

IN THE ABSTRACT

Line 2, after "grooves" cancel "on" and substitute therefor --in--.

Line 8, after "serving" cancel "as a surround to" and substitute therefor --to encompass--.

Signed and Sealed this

*Third* Day of *April 1984*

[SEAL]

*Attest:*

GERALD J. MOSSINGHOFF

*Attesting Officer*

*Commissioner of Patents and Trademarks*